United States Patent [19]

Ragsdale

[11] Patent Number: 4,748,997

[45] Date of Patent: Jun. 7, 1988

[54] HIGH PRESSURE HYDRANT REPAIR APPARATUS AND METHOD OF REPAIR

[76] Inventor: Waymon Ragsdale, P.O. Box 1007, Mineola, Tex. 75773

[21] Appl. No.: 93,641

[22] Filed: Sep. 4, 1987

[51] Int. Cl.[4] ..... F16L 55/18

[52] U.S. Cl. ..... 137/15; 137/283; 137/300; 137/316; 29/402.08

[58] Field of Search ..... 137/315, 316, 320, 283, 137/284, 300, 15; 29/402.03, 402.08

[56] References Cited

U.S. PATENT DOCUMENTS

| | | | |
|---|---|---|---|
| 1,349,062 | 8/1920 | Goldberg | 137/283 |
| 3,865,129 | 2/1975 | Peterson | 137/318 |
| 4,161,958 | 7/1979 | Behle | 137/316 |

*Primary Examiner*—A. Michael Chambers
*Attorney, Agent, or Firm*—Ronald B. Sefrna

[57] ABSTRACT

An apparatus and method of removing and replacing the main water supply valve of a high pressure hydrant without the necessity of shutting off the supply of water to the hydrant, wherein the apparatus generally comprises a hydrant adapter for interconnection of the apparatus to a variety of hydrant configurations, a slide valve chamber and slide valve assembly, a main body, a valve seat wrench and interconnected elongate wrench shaft moveable through the interior of the apparatus, an upper seal assembly to form a water tight sliding seal around the wrench shaft, a valve lifting tool moveable through the interior of the elongate wrench shaft in water tight relation therewith, a wrench activating assembly, a plurality of bleed valves for removal of water from selected portions of the apparatus, and a bypass valve assembly for equalization of water pressure between selected portions of the apparatus. In use, the upper portion of the hydrant to be repaired is removed and the hydrant adapter is attached to the base of the hydrant and the main portion of the apparatus is attached to the hydrant adapter opposite its attachment to the hydrant base. The valve wrench, wrench shaft and valve lifting tool are inserted into the apparatus, which is then sealed against outflow of water, the hydrant valve and seat are released from the hydrant base and lifted through the interior of the apparatus to a position above the slide valve, which is closed to isolate upper and lower sections of the apparatus. The upper section of the apparatus is then opened, a replacement hydrant valve is installed by generally reversing the steps for removal of the original hydrant valve, the apparatus is removed from the hydrant base, and the hydrant is reassembled.

26 Claims, 7 Drawing Sheets

238
212
232
236
234
250
224
246
252
244
242
248
240
216
194
192
3
3
114
46
48
34
22
30
36
42
24
44
26
42
40
40
304
16
306
292
38
294
28
18
12
20
10
32
50
54
56
172
214
52
74
84
100
82
2
14
78
104
102
76
72
70
98
60
86
62
92
106
108
94
88
68
118
114
2
90
112

110
120
116

HIGH PRESSURE HYDRANT REPAIR APPARATUS AND METHOD OF REPAIR

FIELD OF THE INVENTION

This present invention generally relates to apparatus and methods for repair of high pressure hydrants, and more specifically relates to an apparatus and method for removing and replacing the main water supply valve of a water hydrant while avoiding the necessity of shutting off the water supply to the hydrant and avoiding damage to the hydrant base and water supply lines.

BACKGROUND OF THE INVENTION

It has become an almost universal practice for cities and other similar bodies to provide a network of water lines and hydrants for fire fighting purposes, and it is typical for each hydrant location to be provided with a single main valve to open and close the water supply to each such hydrant, without providing a shut-off valve or valves to isolate each hydrant from the main water supply. After a period of time in service it is common for the main hydrant valves to develop leaks and other mechanical problems which require repair or replacement of the valve and valve seat located in the base of the hydrant. As a result of the lack of shut-off valves in the water lines running to and from each hydrant, it is necessary to either shut off the water supply to the entire network which includes the hydrant to be repaired or to perform the repair under full water pressure. Because shutting off the water supply both causes major inconvenience to local residents and renders the local fire protection system inoperative, it is desireable that the hydrant repair be performed under water pressure.

A typical fire hydrant generally comprises a base section which includes the hydrant valve and valve seat as well as the incoming and outgoing water service lines, an elongate barrel extending upward from the base section, and a bonnet which closes the upper end of the barrel and includes means of activating the hydrant valve. When the hydrant valve is opened, water is allowed to flow into the barrel of the hydrant under full pressure, and normally is allowed to flow from the barrel through hose fittings.

Various attempts to device an apparatus and method of removing and replacing hydrant valves without shutting off the water supply to the hydrant have been made, but such attempts have been only marginally successful. One approach to the problem is illustrated by U.S. Pat. No. 1,349,062, to Goldberg, which provides an apparatus intended to allow the main hydrant valve to be removed from the hydrant base and then isolated from the pressurized zone of the hydrant for replacement. The prior approaches provide a partial solution to the problem, but substantial difficulties have remained unresolved. Such difficulties include the problems of damage to the water supply lines during removal of the main hydrant valve, damage to the valve activating means during removal, blowout of the main hydrant valve upon its release from the hydrant base, water hammer during replacement of the valve, and damage to the valve and valve seat during replacement of the valve. These unresolved difficulties and disadvantages often result in damage to the water lines and hydrant base or damage to the replacement valve during the repair attempt to an extent which renders the repair ineffective or creates a situation which is worse than the original problem.

Accordingly, there has continued to be a need for a fully effective apparatus and method of removing and replacing the main hydrant valves without shutting off the water supply to the hydrant and without introducing the noted difficulties and disadvantages to the removal and replacement operation. It is an object of the present invention to provide an apparatus and method for repairing such hydrants in a manner which avoids stress and damage to the water supply lines and hydrant base, as well as avoiding damage to the replacement valve, valve seat and valve activating means. It is a further object of the present invention to provide an apparatus and method for repairing water hydrants in a highly efficient and rapid manner for the purpose of reducing both cost of repair and the time in which the hydrant is out of service.

SUMMARY OF THE INVENTION

The apparatus of the present invention generally comprises an elongate hollow body open at both ends, including a closure means for the purpose of selectively dividing the interior of the apparatus into two isolated sections, a valve wrench and elongate wrench shaft adapted to pass longitudinally through the interior of the body, a valve lifting tool coaxially aligned with the wrench shaft and passing through the interior thereof in water-tight sliding relation, sealing means to provide a sliding water-tight seal between the upper end of the body and the wrench shaft passing therethrough, activating means to rotate the wrench shaft and valve wrench relative to the body of the apparatus, and a hydrant adapter to be sealingly interconnected between the lower end of the body of the apparatus and the hydrant to which it is to be attached. In the preferred embodiment of the invention, the closure means of the apparatus comprises a cam operated slide valve disposed within a flat hollow body. Upon closure of the slide valve, the interior of the apparatus is internally divided into two vertically aligned isolated chambers which may be independently filled with and emptied of water. In addition to the above identified major components, the apparatus of the invention also includes a valved bypass passageway interconnected between the upper portion of the body of the apparatus, above the slide valve, and the lower portion of the body, below the slide valve, for the purpose of equalizing pressure between the two chambers of the body when the slide valve is in a closed position. The apparatus further includes a plurality of bleed valves to allow selective removal of water from different portions of the body of the apparatus.

In operation, either the bonnet or the barrel and bonnet of the hydrant to be repaired are removed, along with the hydrant valve activating means, to provide access to the hydrant valve. A hydrant adapter is attached to the base of the hydrant and the body and slide valve assembly of the apparatus are attached above the hydrant adapter in water-tight relation. With the slide valve in an open position, the valve wrench, wrench shaft and valve lifting tool are inserted into the interior of the apparatus, the lifting tool, which includes a valve engagement means at its lower end, is run down the interior of the wrench shaft and engaged with the stem of the hydrant valve, and the valve wrench is engaged with the hydrant valve and valve seat. Assembly of the apparatus is completed by interconnection of the sealing means to form a water-tight enclosure, and the valve wrench is activated to loosen the hydrant valve and valve seat from the hydrant base. As the main valve is loosened, water flows from the supply lines around the main valve and into the interior of the apparatus. In the preferred embodiment of the invention, hold down chains or cables are provided to prevent a blow-out or forceful ejection of the valve and valve seat, along with the valve wrench and wrench shaft, from the hydrant base upon final release of the interconnection between hydrant valve and hydrant base. When the hydrant valve and valve seat are fully released from the hydrant base, the lifting tool is used to raise the hydrant valve and valve seat in the interior of the apparatus past the slide valve into the upper portion of the body of the apparatus. The slide valve is slide into place and closed to isolate the upper chamber of the apparatus from the lower chamber and hydrant base. The water pressure in the upper chamber of the body of the apparatus may then be released by means of a bleed valve, the upper sealing means released from its attachment to the upper end of the body of the apparatus, and the hydrant valve and valve seat may be lifted from the interior of the apparatus for repair or replacement.

When the hydrant valve and valve seat have been repaired or replacement components selected, the hydrant valve and seat may be replaced in the hydrant base through a general reversal of the removal steps. The repaired or replacement hydrant valve and seat are engaged with the valve lifting tool and reinserted into the interior of the body of the apparatus, along with the lifting tool, valve wrench and wrench shaft, and the sealing means is reattached to form a water-tight seal at the top of the body of the apparatus. The upper chamber of the body of the apparatus is then refilled and repressurized wih water by opening the valve of the bypass passageway between the upper and lower chambers of the body. When the pressure in the upper and lower chambers is equalized the slide valve is opened and the hydrant valve and valve seat are lowered through the interior of the apparatus and brought into contact with the hydrant base. The hydrant valve and valve seat are then started into interconnection with the hydrant base and the interconnection is fully tighted by rotation of the wrench shaft by its activation means, again closing the hydrant against flow of water from the service lines upward through the hydrant valve. The pressure in the interior of the apparatus is released and the water remaining in the interior of the apparatus is removed by opening the bleed valves, and the apparatus may then be disconnected and removed from the hydrant base. The hydrant bonnet or barrel and bonnet, with the hydrant valve activation means, are then replaced on the hydrant base, completing the hydrant repair operation.

In the preferred embodiment of the invention, the apparatus includes water hammer control means and further includes hydrant valve thread starter and protection means, for the respective purpose of eliminating rapid pressure changes during reconnection of the hydrant valve and seat caused by rapid closing of the hydrant valve, and of preventing damage to the mating screw threads of the hydrant valve and seat and the hydrant base during the reconnection operation.

The valve wrench and wrench shaft activating means of the apparatus is designed to confine the rotational forces employed for disconnection and reconnection of the hydrant valve and seat with the hydrant base within the components of the apparatus, thus preventing transfer of such rotational forces to the hydrant base and water supply lines. Various embodiments of such activating means are provided by the present invention. In one embodiment, the activating means comprises a collar disposed concentrically about the valve wrench shaft in sliding relation therewith, a fixed lever arm interconnected to and extending outwardly from the upper rend of the body of the apparatus, a moveable lever arm adapted to be releaseably interconnected at one end to the collar, and a double acting hydraulic cylinder and piston assembly to be interconnected between the outer ends of the fixed lever arm and the moveable lever arms. Upon actuation of the hydraulic cylinder and piston assembly force is applied between the two lever arms, effecting rotation of the moveable lever arm, the collar, the wrench shaft, and the hydrant valve wrench relative to the fixed lever arm and the body of the apparatus. In this embodiment the moveable lever arm is connected to the collar by means of pins, and is repositioned on the collar each time the hydraulic piston reaches its full extension from the associated hydraulic cylinder, thus effecting rotation of the collar and interconnected components in increments. In a variation of this embodiment the collar includes gear teeth about its outer edge, and the moveable lever arm is adapted to independently rotate around the wrench shaft and the collar, and includes a rachet cam to engage the gear teeth of the collar. By sequentially engaging the rachet cam with the gear teeth of the collar, extending the hydraulic piston, disengaging the rachet cam, and retracting the hydraulic piston in repetition, incremental rotation of the wrench shaft and interconnected components can be accomplished without repeatedly disconnecting and reconnecting the movable lever arm and collar.

In a futher embodiment of the activating means the moveable lever arm is omitted, the collar is of larger diameter, and the hydraulic piston and cylinder assembly is replaced by a hydraulic rotary motor interconnected to the fixed lever arm. The outer edge of the collar is provided with gear teeth which mate with the teeth of a gear wheel coaxially interconnected to an output shaft of the hydraulic motor. Upon activation of the hydraulic motor continuous rotation of the collar the thus the wrench shaft and interconnected components may be achieved.

These and other components, steps, and features of the present invention will now be described in more detail with reference to the accompanying drawing figures.

DETAILED DESCRIPTION OF THE INVENTION

Figure 1:
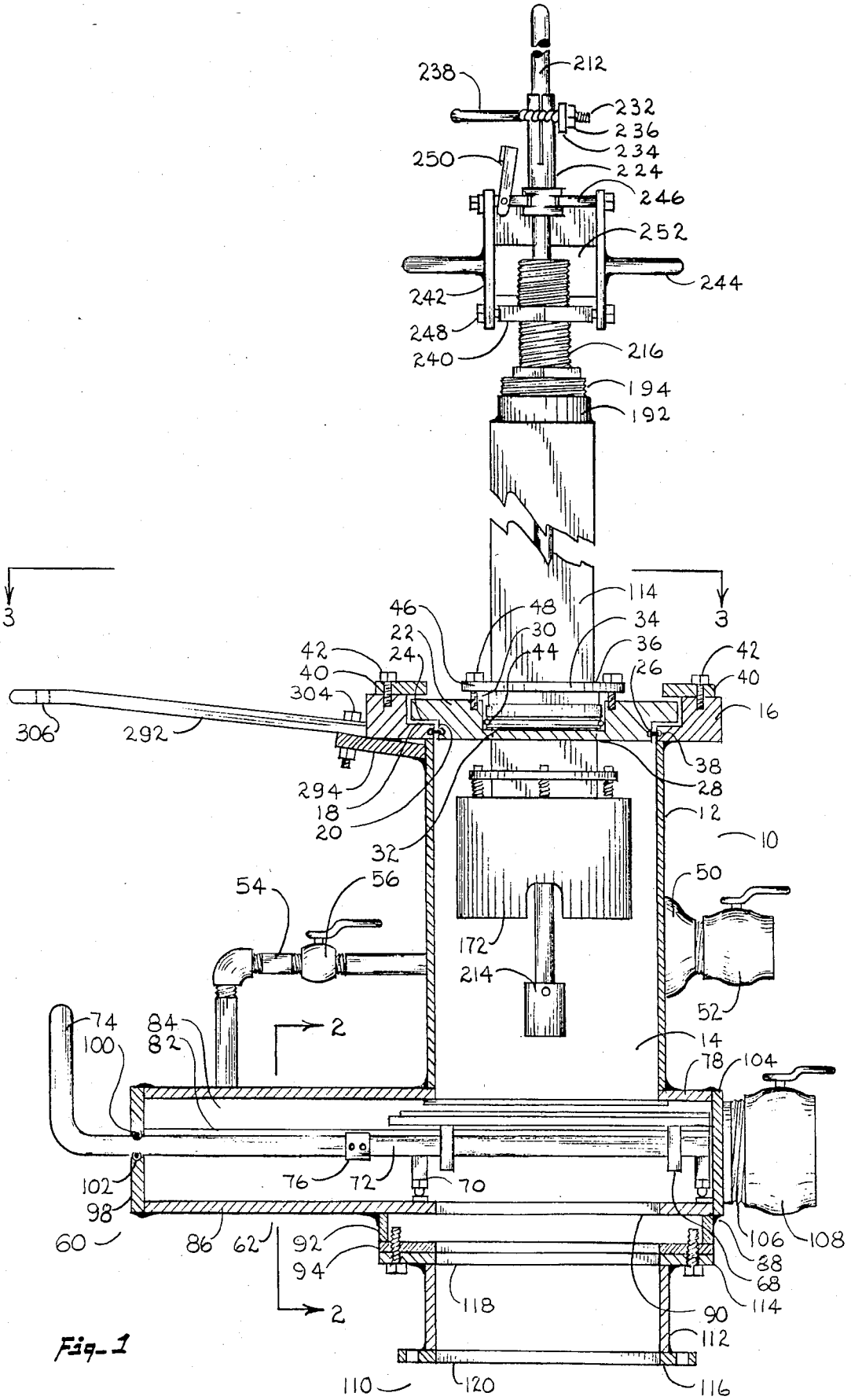
FIG. 1 is a partially cross-sectioned elevation view of the apparatus of the invention.

Referring to the accompanying drawings, the major components of the preferred embodiment of the apparatus of the invention will be seen to comprise body 10, slide valve assembly 60, hydrant adapter 110, valve seat wrench assembly 170, lifting tool and hydrant valve control assembly 210, hydrant valve hold-down assembly 260, and valve wrench activation assembly 290.

Figure 2:
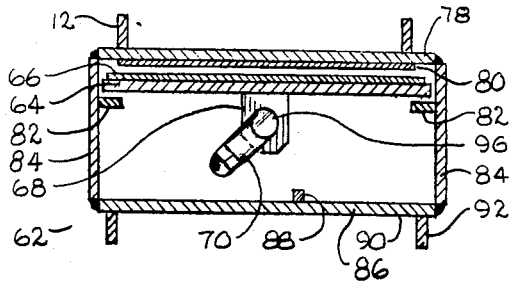
FIG. 2 is a cross-sectional plan view of the apparatus of the invention along line 2—2 of FIG. 1.
Figure 3:
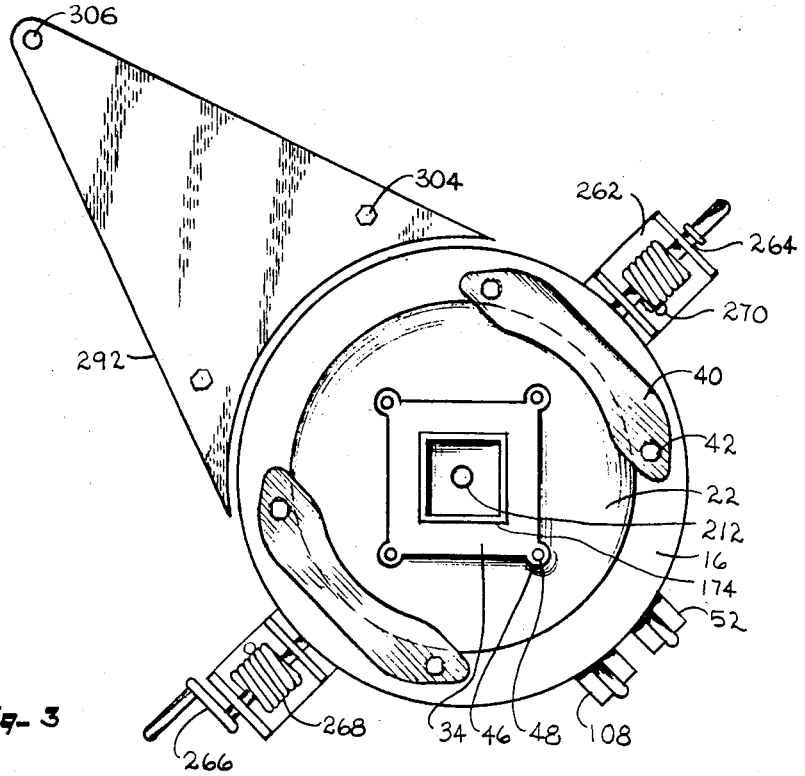
FIG. 3 is a cross-sectional elevation view of the apparatus of the invention along line 3—3 of FIG. 1.

Referring now more particularly to FIG. 1, FIG. 2, and FIG. 3 body 10 comprises an elongated cylinder open at both ends, having continuous annular wall 12, hollow interior 14 and annular closure flange 16 interconnected at its inner edge to the upper edge of wall 12. The inner edge of closure flange 16 is provided with a continuous notch to form a planar lip 18 and rim 20. Body 10 further includes circular bearing plate 22 which is provided with a notch at its outer edge to form lip 24 and rim 26, and is penetrated by central aperture 28. Bearing plate 22 further includes aperture 30 concentric with aperture 28 and extending into bearing plate 22 from its upper surface to form bearing surface 32 to receive packing gland 34 during assembly of the apparatus. Packing gland 34 comprises a flat plate penetrated by central aperture 36 of the same cross-sectional configuration as wrench shaft 174, which is to be received therethrough in a slideable sealing relationship.

Upon assembly of the apparatus, bearing plate 22 is disposed at the upper end of body 10 with lip 24 of bearing plate 22 resting upon lip 18 of closure flange 16 and with rim 26 of bearing plate 22 in close fitting relation with rim 20 of closure flange 16. O-ring 38 is disposed between bearing plate 22 and closure flange 16 to form a water-tight seal and maintain the integrity of the seal during rotation of bearing plate 22 relative to closure flange 16. Bearing plate 22 is retained in position relative to closure flange 16 by means of a plurality of locking bars 40 firmly but removeably interconnected to the upper surface of closure flange 16, preferably by bolts 42 extending through apertures provided in locking bars 40 and into threaded apertures extending into closure flange 16 from its upper surface. Locking bars 40 extend over a portion of the upper surface of bearing plate 22 to retain bearing plate 22 in water tight sealing relation with closure flange 16 while allowing rotation of bearing plate 22 relative to closure flange 16 during operation of the apparatus.

Packing gland 34 is coaxially aligned with apertures 28 and 30 in bearing plate 22 and received in aperture 30 such that the lower surface of packing gland 34 is aligned with bearing surface 32. Wrench shaft 174 is received through aperture 36 in packing gland 34, and the joints between packing gland 34 and bearing plate 22 and between packing gland 34 and wrench shaft 174 are sealed against passage of water by sealing means 44 to form a positive seal while allowing wrench shaft 174 to move longitudinally through aperture 36. Packing gland 34 includes ledge 46 extending partially over the upper surface of bearing plate 22, and packing gland 34 is firmly but removeably retained relative to bearing plate 22 by means of bolts 48 extending through apertures in ledge 46 into threaded apertures extending into bearing plate 22 from its upper surface.

Body 10 further includes hollow bleed nipple 50 penetrating wall 12 and communication with the interior 14 of body 10 to form a passageway for the flow of water from interior 14, and bleed valve 52 for selectively opening and closing such water flow passageway through bleed nipple 50. Wall 12 of body 10 is also penetrated by hollow bypass conduit 54 forming a water flow passageway between interior 14 of body 10 and the interior of slide valve assembly 60. Bypass valve 56 is disposed in line with bypass conduit 54 for selectively opening and closing the water flow passageway formed thereby.

Referring now primarily to FIG. 1 and FIG. 2, slide valve assembly 60 generally comprises a valve body 62, valve plate 64, sealing gasket 66, cam brackets 68, adjustable cam locks 70, cam shaft 72, lock handle 74, and swivel coupling 76. Valve body 62 is, in the preferred embodiment of the invention, a hollow, substantially rectangular shallow box rigidly interconnected to the lower end of body 10. In order to enable the formation of a positive seal between slide valve assembly 60 and the interior of body 10, it is preferable that wall 12 of body 10 extend a short distance into the interior of valve body 62 through an aperture formed in the upper wall 78 of valve body 62 to provide annular ring 80 on the inner surface of upper wall 78. One slide rail 82 is disposed on the inner surface of each of side walls 84 of valve body 62 and rigidly interconnected thereto to provide a support and bearing surface for valve plate 64. Bottom wall 86 of valve body 62 includes cam stops 88 rigidly interconnected to its inner surface to arrest travel of cam locks 70 in the optimum position for creation of a positive seal between lock plate 64 and annular ring 80 upon closing of the slide valve. Bottom wall 86 is penetrated by aperture 90 in coaxial alignment with body 10 and with annular ring 80 to provide a continuous passageway through the interior of the apparatus. Annular spacer 92 is rigidly interconnected to the lower surface of bottom wall 86 and coupling flange 94 is rigidly interconnected to the lower end of annular spacer 92, both in coaxial alignment with aperture 90.

Valve plate 64 comprises a flat plate of sufficient width and length to overlap annular ring 80, is provided with a resilient sealing gasket 66 of similar width and length disposed on its upper surface and with a plurality of cam brackets 68 rigidly interconnected to the lower surface of valve plate 64. Cam brackets 64 are each penetrated by an aperture 96 in coaxial alignment to receive cam shaft 72 therethrough in a direction parallel to the long longitudinal axis of valve body 62. Cam shaft 72 is an elongate rod underlying valve plate 64 disposed through cam brackets 68 and having a plurality of cam locks 70 interconnected thereto with the longitudinal axes of cam locks 70 being parallel to each other in the same plane and mutually perpendicular to the longitudinal axis of cam shaft 72. Cam shaft 72 is interconnected at one end to lock handle 74 through swivel coupling 76. Lock handle 74 comprises an elongate L-shaped rod extending from its interconnection at one of its ends to cam shaft 72 in a direction parallel to the long longitudinal axis of valve body 62 through end wall 98 where a water-tight seal is formed by O-ring 100 disposed in aperture 102 between lock handle 74 and end wall 98. End wall 104 of valve body 62 is penetrated by hollow bleed nipple 106 which communicates with the interior of valve body 62 to provide a water flow passageway through bleed nipple 106 which is selectively opened and closed by bleed valve 108.

Hydrant adapter 110, depicted in FIG. 1, comprises a preferably cylindrical hollow body 112 open at both ends, a first mating flange 114 rigidly interconnected to a first end of body 112, and a second mating flange 116 rigidly interconnected to a second end of body 112. Mating flanges 114 and 116 are penetrated by apertures 118 and 120, respectively, coaxially aligned with the longitudinal axis of body 10 and having the same cross-sectional diameter as body 10. Mating flange 114 is designed to mate with coupling flange 94 of slide valve assembly 60 for releaseable interconnection of hydrant adapter 110 to the interconnected slide valve assembly 60 and body 10 of the apparatus. Mating flange 120 is designed to mate with the base of the hydrant to be repaired by use of the apparatus of the invention in order to form a water-tight seal between the apparatus and such hydrant base, and the size and configuration of mating flange 120 will vary to accomodate various types of hydrant base sizes and configurations.

Figure 6:
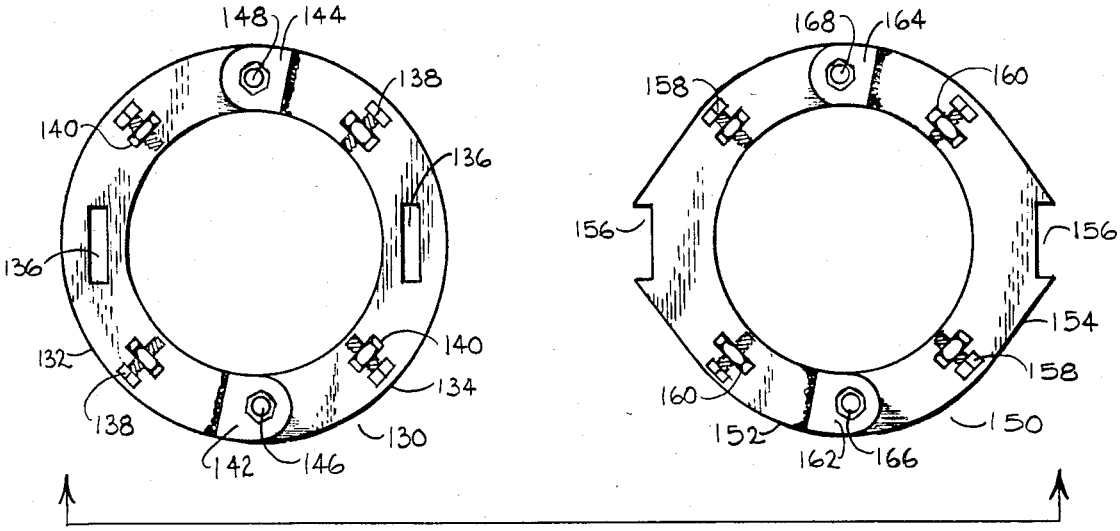
FIG. 6 is a plan view of the hydrant barrel locking ring and adapter locking ring components of the apparatus of the invention.
Figure 7:
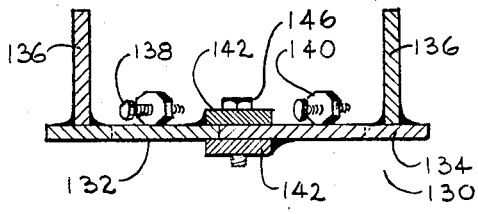
FIG. 7 is an elevation view of the adapter locking ring components of the apparatus of the invention.

The apparatus of the invention further includes means of forming a positive lock between hydrant adapter 110 and the base of the hydrant to be repaired, comprising hydrant barrel locking ring 130 and adapter locking ring 150, depicted in FIG. 6 and FIG. 7. Hydrant barrel locking ring 130 generally comprises an annular ring adapted to be placed around the hydrant base and secured by locking pins and set screws, and includes a first plate 132, a second plate 134, a pair of locking lugs 136, a plurality of set screws 138, and a plurality of fixed nuts 140 to retain set screws 138. A first end of each of plate 132 and plate 134 is provided with overlapping tabs 142 and 144, respectively, defining a slot to receive the second ends of plates 134 and 132, respectively, which are retained in the slots by pin 146 inserted through coaxially aligned apertures in tabs 142 and the second end of plate 134, and by pin 148 inserted through coaxially aligned apertures in tabs 144 and the second end of plate 132. Similarly, adapter locking ring 150 includes plate 152 and 154, dogs 156 to receive lugs 136, set screws 158, fixed nuts 160, tabs 162 and 164 disposed on plates 152 and 154, respectively, and pins 166 and 168. During installation of the apparatus on a hydrant base, barrel locking ring 130 is placed around the barrel of the hydrant base with lugs 136 extending upward, adapter locking ring 150 is placed around body 112 of hydrant adapter 110 such that lugs 136 are received in dogs 156, and set screws 138 and 158 are tightened to form a secure interconnection and lock against rotation of hydrant adapter 110 relative to the hydrant base.

Figure 4:
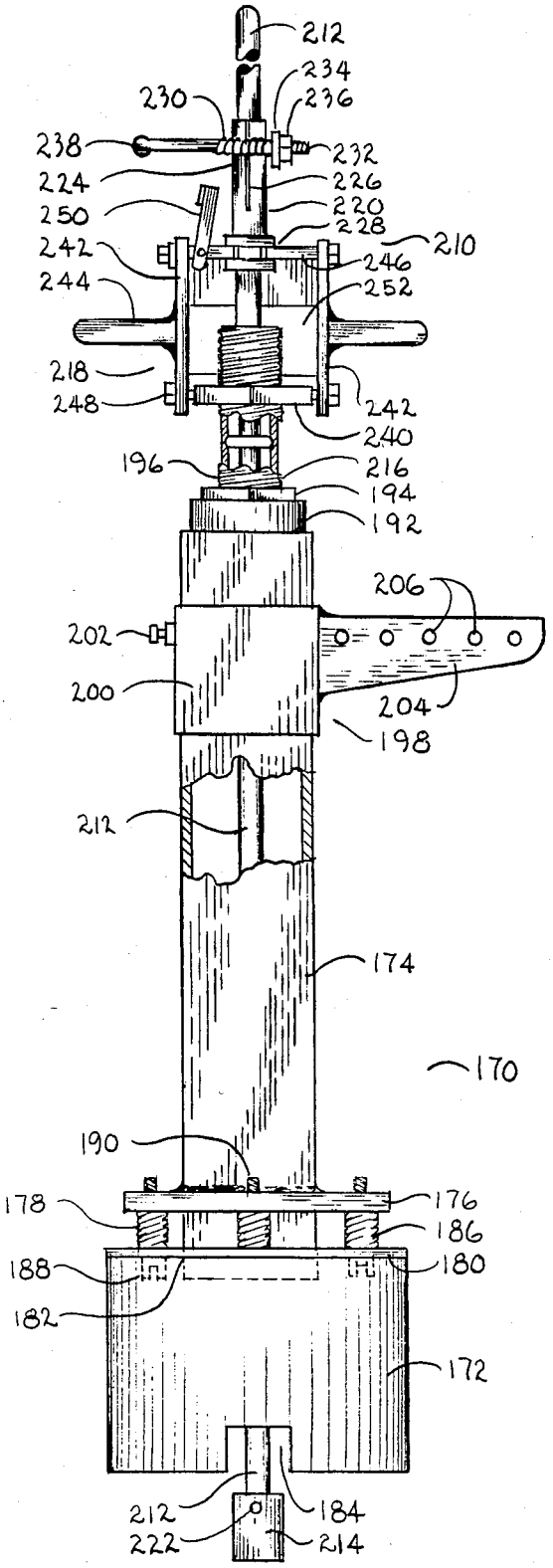
FIG. 4 is a partially cross-sectioned elevation view of the hydrant valve seat wrench assembly, wrench shaft, and lifting tool and hydrant valve control assembly components of the apparatus of the invention.

Referring now particularly to FIG. 4, the valve seat wrench assembly 170 will be seen to include valve wrench 172, wrench shaft 174, connecting flange 176, and floating connectors 176. Valve wrench 172 comprises a hollow body, typically cylindrical but adaptable in design configuration to match the configuration of the hydrant valve and seat to be repaired, open at one end and closed at its opposite end with mounting plate 180 which is penetrated by shaft aperture 182 of the same cross-sectional configuration as wrench shaft 144 to be received therein. The lower, open end of valve wrench includes a plurality of notches 184 sized and disposed so as to mate with the hydrant valve to be repaired. Wrench shaft 174 comprises an elongate hollow shaft of preferably square cross-sectional configuration and includes mounting flange 176 interconnected to the exterior of wrench shaft 174 near its lower end. Valve wrench 172 is floatingly interconnected to wrench shaft 174 by means of a plurality of coil springs 186 interposed between the upper surface of mounting plate 180 and the lower surface of mounting flange 176, and by a plurality of bolts 188 passing through apertures in mounting plate 180 and threaded into coaxially aligned apertures in mounting flange 176. In the preferred embodiment of the invention, the number of spring 186 is four, the number of bolts 188 is two, and the two springs 186 not retained by bolts 188 are retained in position by studs 190 interconnected to the upper surface of mounting plate 180 and passing through coaxially aligned apertures in mounting flange 176.

The upper end of wrench shaft 174 includes hollow open ended cylindrical coupler 192 interconencted thereto to form a transition from the preferably square cross-sectional configuration of wrench shaft 174 to a circular cross-sectional configuration. Coupler 192 is provided with female screw threads on its interior surface to mate with male screw threads provided on the exterior of shaft plug 194 to be received therein. Shaft plug 194 is penetrated by central aperture 196, which is provided with female screw threads to mate with male screw threads provided on the exterior of the nipple of lifting tool and hydrant valve control assembly 210 to be received therein. Valve wrench assembly 170 preferably further includes lifting means 198 to facilitate handling of the assembly. Lifting means 198 comprises shaft clamp 200 to be installed around the exterior of wrench shaft 174, set screw 202 to tighten shaft clamp 200 relative to wrench shaft 174, and lifting bracket 204 interconnected to shaft clamp 200 and including apertures 206 for attachment of lifting means 198 to a hoist chain or cable.

Figure 5:
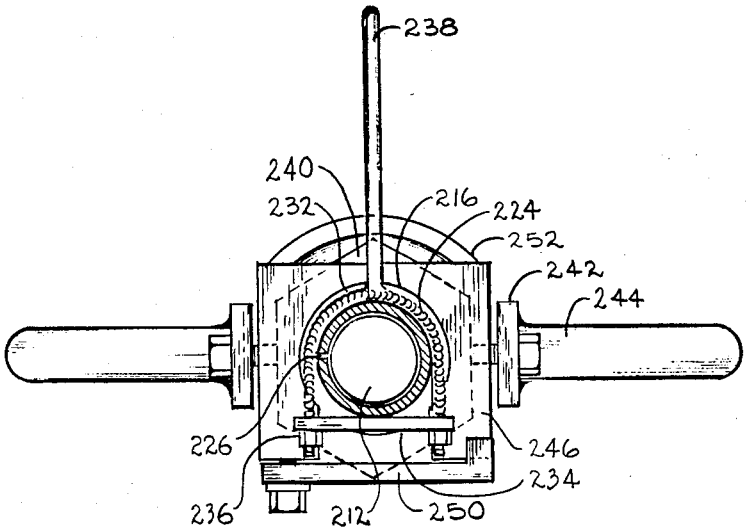
FIG. 5 is a plan view of the lifting tool and hydrant valve control assembly components of the apparatus of the invention.

Still referring to FIG. 4 and to FIG. 5, lifting tool and hydrant valve control assembly 210 comprises elongate lifting rod 212 valve engagement fitting 214, shaft plug 194, nipple 216, control wrench 218, and rod clamp 220. Valve engagement fitting 214 is releaseably interconnected to the lower end of lifting rod 212 by pin 222 passing through coaxially aligned apertures in valve engagement fitting 214 and lifting rod 212, and is adaptable to various configurations compatible with the various means for engaging the stems of the hydrant valves encountered in use of the apparatus of the invention. Nipple 216 comprises a hollow open ended cylinder provided with male screw threads on its exterior to mate with the female screw threads provided in the central aperture of shaft plug 194. Rod shaft 212 extends through the interior of nipple 216 and aperture 196 of shaft plug 194 in water-tight sliding relationship therewith maintained by the inclusion of an o-ring seal between the outer surface of lifting rod 212 and the inner surface of the rod passageway formed on the interior of nipple 216. Rod clamp 220 comprises clamp cylinder 224 which includes compression slots 226, control wrench engagement slot 228, and clamp adjustor 230. Clamp adjustor 230 preferably comprises U-bolt 232, bearing plate 234, nuts 236, and handle 238.

The control wrench 218 of lifting tool and hydrant valve control assembly 210 includes control nut 240 which threads onto nipple 216 by means of mating screw threads, control plates 242, control handles 244 extending from control plates 242, engagement plate 246 extending between control plates 242 and control wrench engagement slot 228, hinge pins 248 extending between control nut 240 and through control plates 242, and swivel latch 250 to secure engagement plate 246 in position within control wrench engagement slot 228. Alignment of control plates 242 is maintained by bracket 252 interconnected between said plates.

Figure 8:
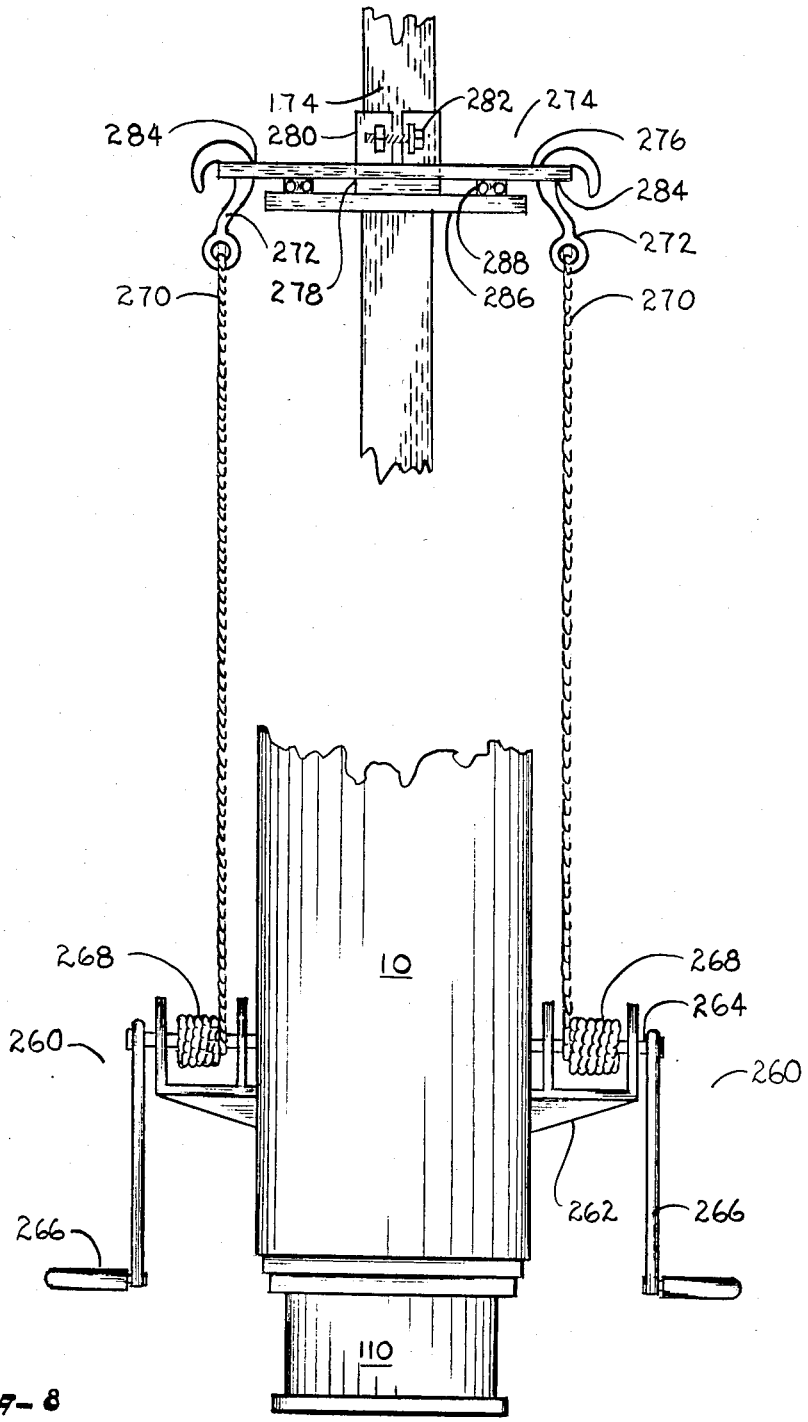
FIG. 8 is an elevation view of the hydrant valve hold-down assembly components of the apparatus of the invention, omitting other components of the apparatus of clarity.

Referring again to FIG. 3 and to FIG. 8, hydrant valve hold-down assembly 260 of the preferred embodiment of the invention will be seen to comprise winch brackets 262 interconnected to the outer surface of wall 12 of body 10, winch shafts 264, winch handles 266, cable reels 268, hold down cables 270 with hooks 272, and thrust bearing 274. Thrust bearing 274 comprises a flat plate 276, central aperture 278 to receive wrench shaft 174, shaft clamp 280 interconnected to the upper surface of plate 276 in coaxial alignment with central aperture 278 to surround wrench shaft 174, set screw 282 to tighten shaft clamp 280 firmly around wrench shaft 174, roller bearings 288 disposed about the upper surface of plate 276, and floating plate 286. Floating plate 286 includes a central aperture of sufficient size to receive shaft clamp 280 therethrough such that floating plate 286 rests upon roller bearings 288 and is freely rotatable relative to plate 276, and further includes hook apertures 284 penetrating floating plate 286 near its outer edge in opposed relation to receive hooks 270.

Figure 9:
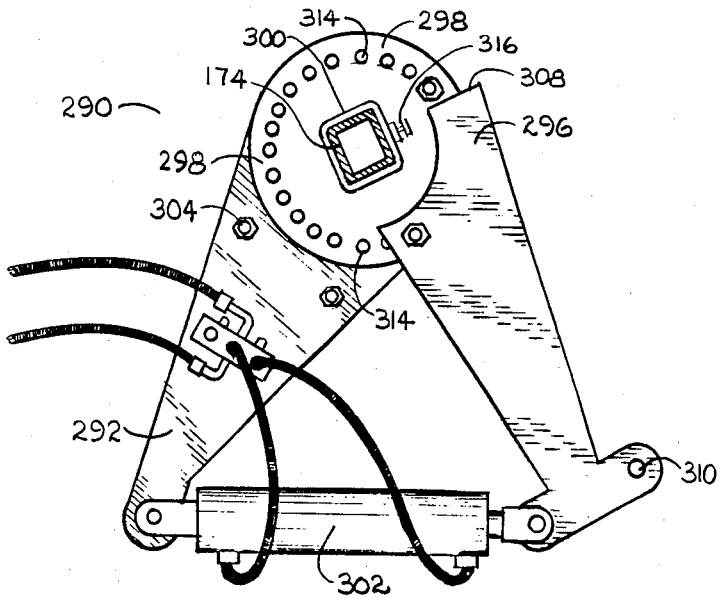
FIG. 9 is a plan view of the hydrant valve wrench activator components of the apparatus of the invention.

The apparatus of the invention also includes valve wrench activation assembly 290 which is provided in a preferred embodiment depicted in FIG. 9, and two alternative embodiments depicted in FIGS. 10 through 13. With reference first to FIG. 9, the preferred embodiment of the wrench activation assembly 290 includes fixed lever arm 292 interconnected to body 10 of the apparatus through lever bracket 294 which is itself interconnected to body 10, as shown in FIG. 1, near the upper end of wall 10 at its point of interconnection with flange 16. Winch activation assembly 290 further includes moveable lever arm 296, wrench activation plate 298, plate clamp 300, and hydraulic actuator 302. Fixed lever arm 292 comprises a substantially triangular flat plate having a concave edge at the base of the triangle with a curvature generally equal to the curvature of the wall 12 of body 10, and penetrated near its concave edge by a plurality of attachment apertures to receive mounting bolts 304 interconnecting fixed lever arm 292 to lever bracket 294. The apex of the fixed lever arm 292 is preferably offset from the major plane of lever arm 272 as shown in FIG. 1 and includes aperture 306 for mounting of hydraulic actuator 302. Moveable lever arm 296 comprises a flat plate of similar generally triangular configuration, with an offset concave cutout at its base, leaving a short bearing edge 308. The apex of moveable lever arm includes opposing mounting ears extending outwardly and having apertures 310 for mounting of hydraulic actuator 302 thereon.

Wrench activation plate 298 comprises a flat circular plate including a central aperture 312 of the same cross-sectional configuration as wrench shaft 174 to receive wrench shaft 174 therethrough, and further including a plurality of apertures 314 disposed about its outer edge for attachment of moveable lever arm 296. Plate clamp 300 comprises a short section of tubing of the same cross-sectional configuration as wrench shaft 174, which is firmly interconnected to the upper surface of wrench activation plate 298 in coaxial alignment with aperture 312 and includes set screw 316 threaded through an aperture penetrating the wall of the tubing of plate clamp 300 for securing wrench activation plate 298 in a set position on wrench shaft 174. In the preferred embodiment and first alternative embodiment of the wrench activation assembly, hydraulic actuator 302 is a double acting hydraulic cylinder and piston.

Figure 10:
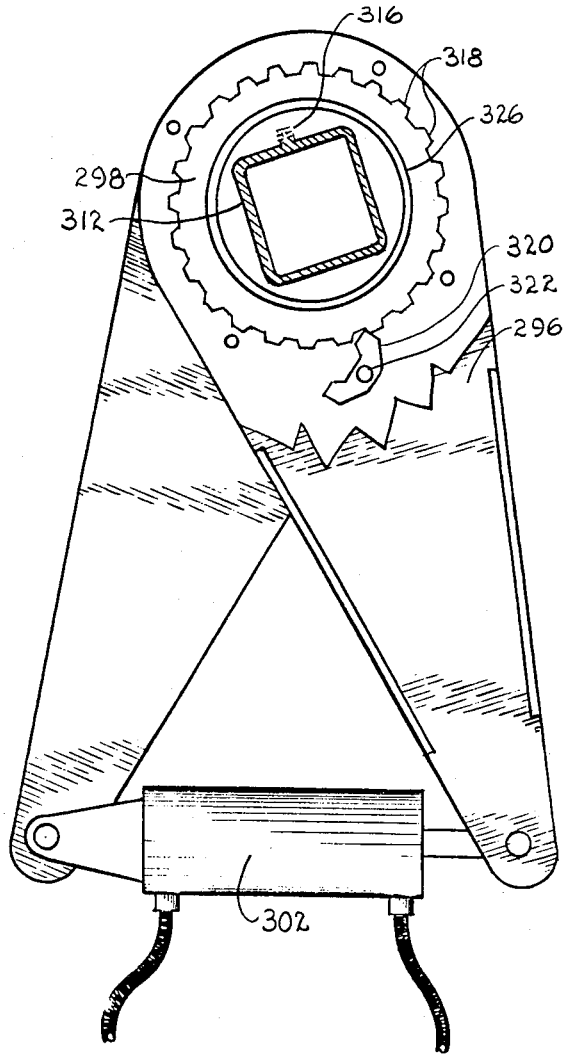
FIG. 10 is a partially cut away plan view of an alternative embodiment of the hydrant valve wrench activator components of the apparatus of the invention.
Figure 11:
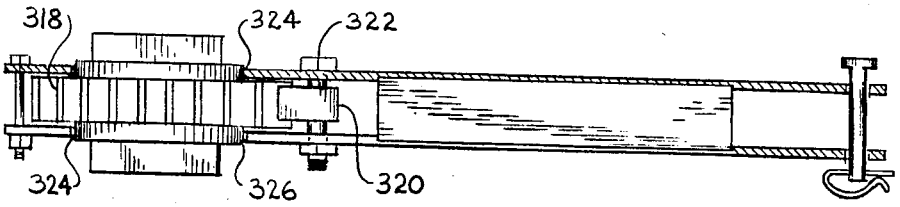
FIG. 11 is an elevation view of the alternative embodiment of the hydrant valve wrench activator components of the apparatus of the invention depicted in FIG. 10.

In the first alternative embodiment of the wrench activation assembly, depicted in FIG. 10 and FIG. 11, apertures 314 of wrench activation plate 298 are replaced by gear teeth 318, moveable lever arm 296 is modified to comprise a pair of flat plates of generally triangular configuration with matching convex bases matching the curvature of wrench activation plate 298 which is enclosed therebetween. Moveable lever arm 296 further includes rachet cam 320 disposed between the flat plates thereof and retained by cam pin 322 such that rachet cam 320 is rotatable about cam pin 322 to contact the gear teeth of wrench activation plate 298. The pair of flat plates of moveable lever arm 296 are penetrated by coaxially aligned apertures 324 which will receive shoulders 326 provided on the upper and lower surfaces of wrench activation plate 298 to allow rotation of such flat plates independent of wrench activation plate 296 with rachet cam 320 disengaged from gear teeth 318.

Figure 12:
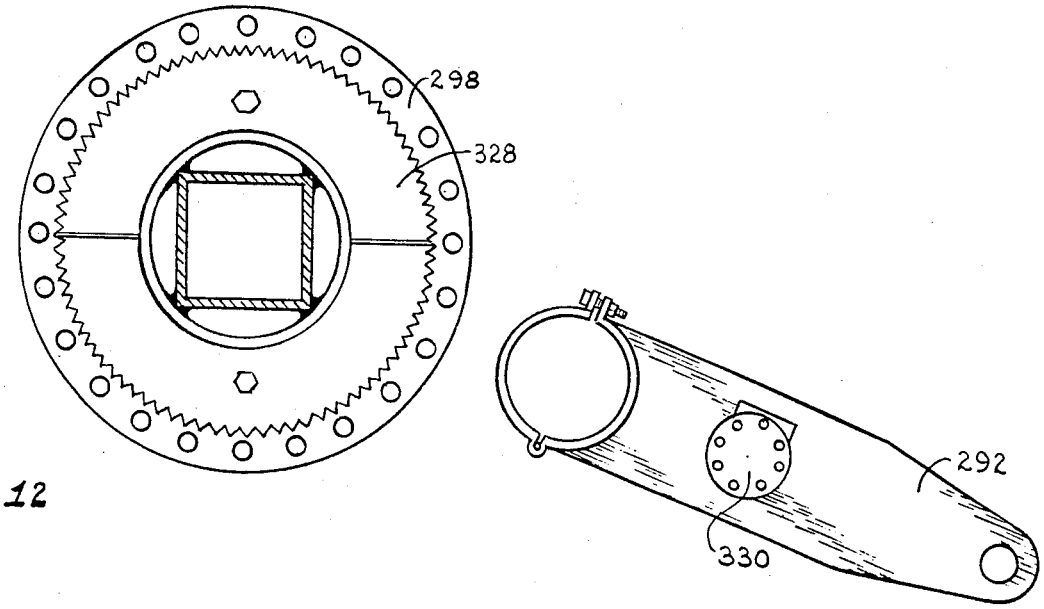
FIG. 12 is a plan view of another alternative embodiment of the hydrant valve wrench activator components of the apparatus of the invention.
Figure 13:
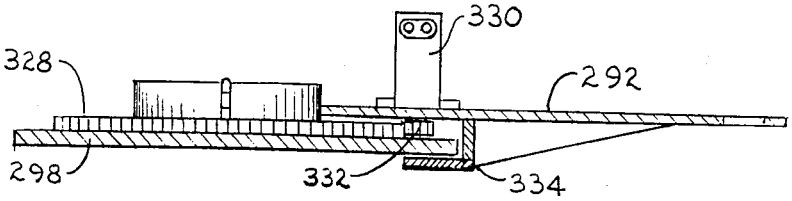
FIG. 13 is an elevation view of the alternative embodiment of the hydrant valve wrench activator components of the apparatus of the invention depicted in FIG. 12.

In the second alternative embodiment, depicted in FIG. 12 and FIG. 13, fixed lever arm 292 is omitted, wrench activation plate 298 includes split gear 328, and hydraulic actuator 302 comprises a rotary hydraulic motor 330 disposed on moveable lever arm 296. The output shaft of motor 330 extends through an aperture in lever arm 296 and is provided with toothed drive gear 332, which is brought into engagement with the teeth of split gear 328 of wrench activation plate 298. Lever arm 296 preferably includes wrench activation plate support bracket 334 interconnected to the lower surface of lever arm 292 to underlie drive gear 332. In use, lever arm 296 is retained relative to body 10 by a retainer chain (not shown) or other suitable retainer means interconnected between lever arm 296 and body 10.

In practicing the method of the invention, the configuration of the hydrant and hydrant valve to be repaired is identified, and selection of appropriately configured hydrant adapter 110, valve wrench 172, and valve engagement fitting 214 is made. The bonnet or bonnet and barrel of the hydrant to be repaired is removed, and the valve activation means is disengaged from the hydrant valve stem and removed. The apparatus of the invention is then assembled on the hydrant.

The assembly operation generally comprises the steps of placing hydrant adapter 110 on the hydrant base or hydrant barrel, locking the hydrant adapter in place by attaching hydrant barrel locking ring 130 around the hydrant base, attaching adapter locking ring 150 around hydrant adapter 110 and engaging lugs 136 with dogs 156, and attaching the interconnected slide valve assembly 60 and body 10 to hydrant adapter 110 by interconnecting flanges 94 and 114.

Valve seat wrench assembly components and lifting tool and hydrant valve control assembly components are interconnected, the combined assemblies are inserted into the interior 14 of body 10, valve engagement fitting 214 is brought into engagement with the stem of the hydrant valve, valve wrench 172 is brought into engagement with the hydrant valve, and the apparatus is closed and sealed against outflow of water. The valve wrench activation assembly 290 is attached to the body of the apparatus, and hydrant valve hold-down assembly is connected to retain the hydrant valve against blow out.

The hydraulic actuator 302, or alternatively, 330, is activated to create a rotation of wrench shaft 174 and valve wrench 172 relative to the fixed portions of the apparatus and thus a rotation of the hydrant valve relative to the hydrant base. As a result of the design of the wrench activation assembly, the rotational forces imposed by that assembly are balanced and no net rotational force is transferred to the hydrant base or to the water supply lines leading to the hydrant base.

As rotation of the valve seat wrench assembly continues, the hydrant valve rises from the hydrant base, and hydrant hold-down assembly 260 is adjusted to maintain retention of the valve seat wrench assembly and hydrant valve against the force of water behind the hydrant valve. Upon disconnection of the hydrant valve from the hydrant base, water flows rapidly into the interior of the apparatus, and pressures are rapidly equalized. With release of the hydrant valve from the hydrant base the valve seat wrench assembly 170, the lifting tool and hydrant valve control assembly 210 and the hydrant valve are raised within the interior of the apparatus until such components are contained within interior 14 of body 10 above the level of the slide valve assembly 60. The slide valve is closed by sliding valve plate 64 into position under annular ring 80 along slide rails 82 and turning valve handle 74 to rotate cam shaft 72 and cam locks 70 until valve plate 64 and sealing gasket 66 are forced into tight contact with annular ring 80 and cam locks 70 are arrested against cam stops 88. With closure of slide valve assembly 60 the apparatus of the invention is divided into two isolated chambers, with the valve seat wrench assembly, lifting tool assembly, and hydrant valve contained within the upper chamber.

Bleed valve 52 is opened to release the pressure in the upper chamber of the apparatus and remove a portion of the water therefrom. The apparatus may now be opened by removal of locking bars 40, and the hydrant valve, with engaged components of the apparatus, removed for repair or replacement.

When the hydrant valve has been repaired or replaced, and reengaged with the engagement fitting 214 and valve wrench 172, the apparatus is reassembled with the valve and associated components of the apparatus in place within the upper chamber, and the apparatus is again sealed against water pressure. Bleed valve 52 is closed, and bypass valve 56 is opened to equalize pressure between the two chambers of the apparatus. When the pressure is equalized, slide valve assembly 60 is opened and the hydrant valve is lowered until it is in contact with the hydrant base and ready to be reinstalled therein. The design of the valve seat wrench assembly of the apparatus allows the hydrant valve to float in limited deviation from the longitudinal axis of wrench shaft 174, in order to allow alignment of the hydrant valve threads with the mating threads of the hydrant base and avoid thread damage and improper valve installation. When the valve and base threads are properly aligned, the valve is tightened in the hydrant base by activation of the selected wrench activation assembly.

During the hydrant valve installation operation, the hydrant valve hold-down assembly 260 is utilized to pull the hydrant valve into position relative to the hydrant base against the pressure increase resulting from decreasing the volume of the interior of the apparatus by lowering the hydrant valve and valve seat wrench assembly toward the hydrant base. During the wrench activation operation to replace the hydrant valve in the hydrant base, the valve control assembly 210 is utilized to prevent rapid closing of the hydrant valve, with resulting water hammer. If control is not exercised, it has been found that the hydrant valve will close extremely rapidly and produce a water hammer which is often damaging to water supply lines of the fire control system. With the hydrant valve in place, the valve control assembly 210 is used to close the hydrant valve slowly by rotation of nut 240 around nipple 216 by means of handles 244. This control assembly may also be used to test the operation of the hydrant valve by opening and closing such valve before the apparatus is removed from the hydrant base.

When the operation of the hydrant has been satisfactorily verified, bleed valves 52 and 108 are opened to release pressure on the interior of the apparatus, the apparatus is removed from the hydrant base, and the hydrant is reassembled, completing the repair operation.

Although the primary features of the apparatus of the invention are directed to repair of a hydrant under pressure, it will be understood that a simplified embodiment of the apparatus of the invention is useful in association with repair of a hydrant provided with shut-off valves to isolate the hydrant from its water supply, for the purpose of removing and replacing a hydrant valve and valve seat threaded into a hydrant base without imposing rotational forces between the hydrant base and the supply lines connected to the hydrant base. In such a simplified embodiment, the components of valve wrench activation assembly 290 remain as described above. The balance of the components of the simplified embodiment comprise body 10, adapted for direct interconnection to hydrant adapter 110, hydrant adapter 110, valve seat wrench assembly 170, and simplified bearing plate 22, which functions only to support wrench shaft 174 in coaxial alignment with body 10.

The foregoing detailed descriptions of the preferred and alternative embodiments of the apparatus and method of the invention are for purposes of illustration and not limitation, and it will be readily understood that the apparatus and method are adaptable to various additional embodiments and modifications without departing from the scope and spirit of the invention.

What is claimed is:

1. A method of repairing a high pressure hydrant incorporating a hydrant base, a hydrant valve and valve seat interconnected to the hydrant base by mating screw threads, and one or more fluid lines interconnected to the hydrant base below the hydrant valve and valve seat to conduct pressurized fluid to or from the hydrant base, where repair of the hyrdant includes removal and replacement of the hydrant valve and valve seat without shutting off the fluid lines interconnected to the hydrant base, comprising the steps of:

removing portions of the hydrant above the hydrant base so as to create an unobstructed straight passageway to the hydrant valve and valve seat and hydrant base;

selecting an appropriately configured hydrant adapter for fluid-tight interconnection to the hydrant base and interconnecting said hydrant adapter in fluid-tight relation to the hydrant base;

creating a positive lock between said hydrant base and said hydrant adapter to prevent rotation of said hydrant adapter relative to said hydrant base;

interconnecting a first end of an elongate hollow body, having coaxially aligned first and second open ends with a straight passageway between said ends, and closure means intermediate said first and second ends of said body for dividing said body into first and second chambers and creating a fluid-tight seal between said chambers, to said hydrant adapter in fluid-tight relation therewith;

selecting a hydrant valve engagement socket of appropriate configuration to be placed over the hydrant valve and valve seat to be removed from the hydrant base and engaged with said hydrant valve and valve seat to transfer rotational force thereto;

interconnecting said hydrant valve engagement socket to an elongate hollow open ended wrench shaft with the longitudinal axis of said hydrant valve engagement socket in coaxial alignment with the longitudinal axis of said wrench shaft;

selecting a hydrant valve engagement fitting of appropriate configuration to be releaseably interconnected to the valve stem or other appropriate lifting point of the hydrant valve and valve seat for the purpose of raising and lowering said hydrant valve and valve seat relative to the hydrant base;

interconnecting said hydrant valve engagement fitting to an elongate lifting rod of greater length than said wrench shaft, with the longitudinal axis of said hydrant valve engagement fitting in coaxial alignment with the longitudinal axis of said lifting rod;

inserting said lifting rod through the hollow interior of said wrench shaft in coaxial alignment therewith, with said hydrant valve engagement socket and said hydrant valve engagement fitting in concentric relationship at the same respective ends of said wrench shaft and of said lifting rod, and forming a slideable and rotatable fluid-tight seal between said wrench shaft and said lifting rod so as to allow said lifting rod to move longitudinally and to rotate relative to said wrench shaft while maintaining the integrity of said seal;

inserting the combined hydrant valve engagement socket and wrench shaft, and hydrant valve engagement fitting and lifting rod through the second open end of said body, past the open closure means of said body, to the location of said hydrant valve and valve seat in the hydrant base, releaseably interconnecting said hydrant valve engagement fitting to said hydrant valve, and engaging said hydrant valve engagement socket with said hydrant valve and valve seat;

forming a slideable and rotatable fluid-tight seal at said second end of said body between said body and said wrench shaft so as to close said body against the outflow of pressurized fluid from the interior thereof through said second end while allowing said wrench shaft to move longitudinally and rotationally relative to said body;

actuating rotation of said wrench shaft, thus actuating rotation of said hydrant valve engagement socket interconnected thereto and of said hydrant valve and valve seat engaged thereby, relative to said body, and thus relative to said hydrant adapter and to the hydrant base through their respective interconnections and continuing such rotation until said hydrant valve and valve seat are separated from said hydrant base;

imposing a lifting force to said lifting rod, raising said lifting rod, hydrant valve engagement fitting, and hydrant valve and valve seat, as well as said wrench shaft and hydrant valve engagement socket, within the interior of said body to a position above said closure means of said body;

actuating said closure means to divide said body into two fluid-tight chambers with said hydrant valve and valve seat suspended in a first, upper chamber proximate said first end of said body;

releasing fluid pressure from said first chamber of said body by opening a bleed valve assembly in fluid communication with said first chamber;

releasing the fluid-tight seal formed at said first end of said body;

removing said lifting rod, hydrant valve engagement fitting, wrench shaft, hydrant valve engagement socket, and hydrant valve and valve seat from said body through said first open end of said body, whereupon said hydrant valve and valve seat may be disconnected from said hydrant valve engagement fitting and disengaged from said hydrant valve engagement socket for repair or replacement;

releaseably interconnecting said hydrant valve engagement fitting to and engaging said hydrant valve engagement socket with the repaired or a new hydrant valve and valve seat, inserting said hydrant valve and valve seat, lifting rod, hydrant valve engagement fitting, wrench shaft and hydrant valve engagement socket, and hydrant valve and valve seat into said first chamber of said body, and reforming said seal between said body and said wrench shaft at said first end of said body;

equalizing fluid pressure between said first chamber and said second chamber of said body by opening a bypass valve assembly creating a fluid flow path between said chambers for flow of pressurized fluid from said second chamber to said first chamber;

opening said closure means of said body and lowering said hydrant valve and valve seat, with interconnected hydrant valve engagement fitting and lifting rod, and with engaged hydrant valve engagement socket and its interconnected wrench shaft, through the interior of said body into contact with the hydrant base;

actuating rotation of said wrench shaft to produce a rotation of said hydrant valve engagement socket and thus the hydrant valve and valve seat relative to said hydrant base so as to begin threading said hydrant valve and valve seat into said hydrant base by means of their mating screw threads;

continuing rotation of said wrench shaft until the hydrant valve and valve seat are firmly interconnected to the hydrant base in fluid-tight relation, and effecting closure of said hydrant valve against fluid flow therethrough;

releasing fluid pressure above the hydrant valve and valve seat by opening a bleed valve assembly in fluid flow communication with the interior of said body;

releasing the interconnection between said hydrant adapter and the hydrant base, removing the repair apparatus from the hydrant base, and reassembling the hydrant above the hydrant base.

2. The method of claim 1, further comprising the steps of:

after the step of forming a fluid-tight seal between said first end of said body and said wrench shaft, interconnecting a thrust bearing to said wrench shaft above said seal, with said thrust bearing adapted to allow rotation of said wrench shaft relative to said thrust bearing while preventing longitudinal movement of said wrench shaft relative to said thrust bearing;

interconnecting said thrust bearing to a plurality of hold-down winches interconnected to said body, through a plurality of flexible hold-down retainers;

actuating said hold-down winches during rotation of said wrench shaft and the associated release of the hydrant valve and valve seat from the hydrant base to control upward movement of said hydrant valve and valve seat, through said hydrant valve engagement socket and wrench shaft, to prevent forceable ejection of said hydrant valve and valve seat from said hydrant base upon release of the interconnection therebetween; and after reinsertion of the hydrant valve and valve seat, along with said hydrant valve engagement fitting and lifting rod and with said hydrant valve engagement socket and wrench shaft into the interior of said body, reforming of said fluid-tight seal at said first end of said body, equalizing of fluid pressure between said first and second chambers of said body, and opening of said closure means, actuating said winches to shorten said hold-down retainers and force said hydrant valve and valve seat into contact with the hydrant base.

3. The method of claim 2, further comprising the steps of:

after insertion of said lifting rod through the interior of said wrench shaft, adjustably interconnecting said lifting rod and said wrench shaft by means of a lifting rod clamp releaseably interconnected to said lifting rod above the end of said wrench shaft opposite its interconnection to said hydrant valve engagement socket, and of a hydrant valve control unit interconnected between said lifting rod clamp and said end of said wrench shaft, adapted to allow precise control of the position of said lifting rod and interconnected hydrant valve engagement fitting relative to said wrench shaft and interconnected hydrant valve engagement socket; and after reattachment of the hydrant valve and valve seat to the hydrant base, operating said hydrant valve control unit to lower said lifting rod, hydrant valve engagement fitting, and hydrant valve stem relative to said wrench shaft, closing said hydrant valve in a controlled manner to prevent formation and transmission of fluid pressure waves through the fluid lines associated with the hydrant being repaired.

4. The method of claim 3, wherein the steps of actuating rotation of said wrench shaft additionally include:

interconnecting a wrench activation plate around said wrench shaft in sliding relation therewith so as to allow longitudinal movement of said wrench shaft but prevent rotation of said wrench shaft relative to said wrench activation plate;

releasably interconnecting an elongate moveable lever arm to said wrench activation plate with the longitudinal axis of said moveable lever arm perpendicular to the longitudinal axis of said wrench shaft;

interconnecting an elongate fixed lever arm to said body with the longitudinal axis of said fixed lever arm perpendicular to the aligned longitudinal axes of said body and said wrench shaft; and applying force between the ends of said lever arms opposite their interconnection to said wrench activation plate and to said body, respectively, to induce rotation of said wrench shaft without imposition of rotational force between the hydrant base and the fluid lines interconnected thereto.

5. A method of repairing a high pressure hydrant incorporating a hydrant base, a hydrant valve and valve seat interconnected to the hydrant base by mating screw threads, and fluid lines conducting pressurized fluid to or from the hydrant base below the hydrant valve and valve seat, in which the hydrant valve and valve seat are removed from and replaced in the hydrant base by rotation of the hydrant valve and valve seat relative to the hydrant base without imposing rotational force between the hydrant base and the fluid lines interconnected thereto, comprising the steps of:

removing components of the hydrant above the hydrant valve and valve seat to form an unobstructed passageway to the hydrant valve and valve seat in the hydrant base;

interconnecting the second end of an elongate hollow body with coaxially aligned first and second open ends to the hydrant base and locking said body in place to prevent rotation of said body relative to the hydrant base;

inserting a hydrant valve wrench, having a hydrant valve engagement socket adapted to engage the hydrant valve and valve seat for transmitting rotational force thereto and an elongate wrench shaft inteconnected to said hydrant valve engagement socket with their respective longitudinal axes in alignment, through the interior of said body along the longitudinal axis of said body and bringing said hydrant valve wrench into engagement with the hydrant valve and valve seat;

interconnecting hydrant valve wrench actuating means between said wrench shaft and said body; and applying rotational force between said body and said wrench shaft by activation of said hydrant valve wrench actuating means to produce rotation of said wrench shaft and, through said wrench shaft, of said hydrant valve engagement socket and of the hydrant valve and valve seat relative to said body and the hydrant base interconnected thereto.

6. The method of claim 5, wherein said hydrant valve wrench actuating means comprises:

an elongate fixed lever arm with first and second ends, interconnected at its first end to said body with its longitudinal axis perpendicular to the longitudinal axis of said body;

a wrench activation plate attached to said wrench shaft so as to allow longitudinal movement of said wrench shaft relative to said wrench activation plate while preventing rotation of said wrench shaft about its longitudinal axis relative to said wrench activation plate;

an elongate moveable lever arm with first and second ends, releaseably interconnected at its first end to said wrench activation plate with the longitudinal axis of said moveable lever arm perpendicular to the longitudinal axis of said wrench shaft; and a double acting hydraulic cylinder and piston assembly interconnected between said second ends of said fixed lever arm and said moveable lever arm, respectively.

7. An apparatus for repairing a high pressure hydrant incorporating a hydrant base, a hydrant valve and valve seat releaseably interconnected to the hydrant base, and one or more fluid lines conducting fluid to or from the hydrant base, comprising:

a hollow body having first and second coaxially aligned openings into the interior thereof;

means of removeably interconnecting said body to a hydrant base in fluid-tight relation therewith, forming a passageway from said hydrant base into the interior of said body through said second opening into the interior of said body;

closure means for dividing the interior of said body into first and second chambers and creating a fluid-tight separation between said first and second chambers;

wrench means for releasing the interconnection between the hydrant valve and valve seat and said hydrant base and for reconnecting said hydrant valve and valve seat to said hydrant base, including an elongate portion to extend through said first opening in said body, through the interior of said body, and through said second opening in said body to said hydrant valve and valve seat in said hydrant base;

lifting means for engaging said hydrant valve and valve seat and for raising and lowering said hydrant valve and valve seat relative to said hydrant base through the interior of said body, including an elongate portion to extend through said first opening in said body, through the interior of said body, and through said second opening in said body to said hydrant valve and valve seat in said hydrant base;

means for sealing said first opening in said body around said elongate portion of said wrench means and around said elongate portion of said lifting means extending through said first opening fluid-tight relation so as to retain pressurized fluid within the interior of said body while allowing longitudinal and rotational movement of said elongate portion of said wrench means and of said elongate portion of said lifting means relative to said body; and actuating means for activating said wrench means to release the interconnection between said hydrant valve and valve seat and said hydrant base and for reconnecting said hydrant valve and valve seat to said hydrant base.

8. The apparatus of claim 7, further comprising:

first pressure release means for selectively releasing fluid pressure in said first chamber of said body formed upon actuation of said closure means;

second pressure release means for selectively releasing fluid pressure in said second chamber of said body formed upon actuation of said closure means; and bypass means for selectively equalizing fluid pressure between said first chamber of said body and said second chamber of said body formed upon actuation of said closure means.

9. The apparatus of claim 7, wherein said closure means comprises a mechanically actuated valve disposed in relation to said body such that an unobstructed passageway is formed between said first and second openings of said body through the interior of said body with said mechanically actuated valve in an open position.

10. The apparatus of claim 7, further comprising:

locking means for positively locking the position of said body relative to said hydrant base and preventing rotation of said body relative to said hydrant base upon releaseable interconnection of said body to said hydrant base.

11. The apparatus of claim 7, wherein said wrench means and said lifting means are mutually concentric, the elongate portion of said wrench means is hollow, the elongate portion of said lifting means extends through the hollow interior of said wrench means in coaxial alignment therewith, and a fluid-tight seal is formed between the elongate portions of said wrench means and of said lifting means to prevent passage of fluid through the interior of said elongate portion of said wrench means while allowing both longitudinal and rotational movement of said lifting means relative to said wrench means.

12. An apparatus for repairing a high pressure hydrant incorporating a hydrant base, a hydrant valve and valve seat releaseably interconnected to the hydrant base by screw threads, and one or more fluid lines conducting pressurized fluid to or from the hydrant base below the hydrant valve and valve seat, comprising:

an elongate hollow body having a longitudinal axis, a continuous side wall, a first open end coaxially aligned with the longitudinal axis of said body, and a second open end coaxially aligned with the longitudinal axis of said body, and further having a least cross-sectional dimension larger than the largest cross-sectional dimension of the valve and valve seat of the hydrant to be repaired;

a closure valve disposed intermediate said first and second open ends of said body near said second end, for dividing the hollow interior of said body into first and second chambers and creating a fluid-tight separation between said first and second chambers across said closure valve;

a first bleed valve assembly for releasing fluid pressure and forming a fluid flow passageway from said first chamber of said body, having a hollow open ended first bleed nipple with one end received in a first aperture penetrating the wall of said body to said first chamber, and a first bleed valve interconnected to the opposite end of said first bleed nipple;

a second bleed valve assembly for releasing fluid pressure and forming a fluid flow passageway from said second chamber of said body, having a hollow open ended first bleed nipple with one end received in a second aperture penetrating the wall of said body to said second chamber, and a second bleed valve interconnected to the opposite end of said first bleed nipple;

a bypass valve assembly for equalizing fluid pressure between said first and second chambers of said body and forming a fluid passageway between said first and second chambers, having a hollow open ended first bypass nipple with one end received in a first bypass aperture penetrating the wall of said body to said first chamber, a second bypass nipple received in a second bypass aperture in fluid flow communication with said second chamber, and a bypass valve interconencted between the respective ends of said first and second bypass nipples opposite their ends received in said bypass apertures;

a hollow bodied hydrant adapter having a first open end and a second open end adapted to match the configuration of the hydrant base of the hydrant to be repaired, releaseably interconnected in fluid-tight relation at its first end to the second open end of said body in coaxial alignment with the longitudinal axis of said body, and releaseably interconnected in fluid-tight relation at its second end to the hydrant base above the hydrant valve and valve seat interconnected thereto;

a hydrant valve wrench assembly to be inserted longitudinally through the interior of said body, having a hollow valve engagement socket open at one end and adapted to engage the hydrant valve and valve seat of the hydrant to be repaired for the purpose of actuating rotational movement thereof relative to the hydrant base, an open-ended hollow elongate wrench shaft interconencted at one of its ends to said valve engagement socket in coaxial alignment so as to create a passageway from the open end of said valve engagement socket through the hollow interior of said wrench shaft;

a hydrant valve lifting and control assembly to be inserted longitudinally through the hollow interior of said wrench shaft in coaxial alignment therewith, having a valve engagement fitting adapted to engage the hydrant valve of the hydrant to be repaired for the purpose of raising and lowering said hydrant valve along the longitudinal axis of said body of the apparatus, an elongate lifting rod of greater length than said wrench shaft, interconnected at one end to one end of said valve engagement fitting in coaxial alignment thereiwth, sealing means for providing a fluid-tight seal between said lifting rod and said wrench shaft while allowing longitudinal movement of said lifting rod relative to said wrench shaft, a lifting rod clamp to be disposed around said lifting rod above the end of said wrench shaft opposite the interconnection of said wrench shaft to said valve engagement socket, and hydrant valve control means to be interconnected between said lifting rod clamp and the end of said wrench shaft opposite the interconnection between said wrench shaft and said valve engagement socket for the purpose of controlling and adjusting the position of said lifting rod and interconnected valve engagement fitting relative to said hydrant valve wrench assembly;

an upper seal assembly for sealing said first open end of said body against the flow of pressurized fluid therethrough from the interior of said body while allowing said wrench shaft to move rotationally and longitudinally relative to said body, having a closure plate with a central aperture to receive said wrench shaft therethrough, disposed within said first open end of said body and retained therein in rotatable sealing relation thereto, and a packing gland to be disposed around said wrench shaft in slideable sealing relation thereto and received in said aperture in said closure plate between said closure plate and said wrench shaft extending therethrough;

a blow-out preventer and hydrant valve hold-down assembly to restrain the hydrant valve against fluid pressure upon release of the interconnection between said hydrant valve and the hydrant base and to pull said hydrant valve toward said hydrant base against fluid pressure, having a plurality of winch reels each rotatably in and interconnected to one of a plurality of winch reel brackets symetrically disposed about the outer surface of said body and interconnected thereto, a thrust bearing to be disposed around said wrench shaft in coaxial alignment therewith and adapted to be releaseably interconnected thereto at any selected position along said wrench shaft, and a plurality of elongate flexible retainers each releaseably interconnected at one end to said thrust bearing and interconnected at its opposite end to one of said winch reels for winding thereon; and a hydrant valve wrench actuator for actuating rotational movement of said hydrant valve wrench assembly and hydrant valve and valve seat relative to the hydrant base, having a fixed lever arm firmly interconnected to said body near its first end and extending outwardly therefrom, a wrench activation plate with a central aperture to receive said wrench shaft therethrough in close sliding relation and adapted to allow movement of said wrench activation plate longitudinally along said wrench shaft while preventing rotation of said wrench activation plate relative to said wrench shaft, a moveable lever arm adapted to be releaseably interconnected at one end to said wrench activation plate with the longitudinal axis of said moveable lever arm lying generally in the plate of said wrench activation plate, and actuating means interconnected between the ends of said fixed lever arm and of said moveable lever arm opposite their interconnections to said body and to said wrench activation plate, respectively, to induce movement of said moveable lever arm relative to said fixed lever arm and thus rotation of said wrench activation plate and valve wrench assembly about the coaxially aligned longitudinal axes of said valve wrench assembly and of said body.

13. The apparatus of claim 12, wherein said closure valve is a gate valve.

14. The apparatus of claim 12, wherein said closure valve is a slide valve comprising:

a hollow substantially rectangular valve body interconnected intermediate said first and second ends of said body of the apparatus, having an upper wall penetrated by an aperture of the same configuration and dimensions as the cross-section of said body of the apparatus and coaxially aligned with the longitudinal axis of said body of the apparatus, a shallow ring extending into the interior of said valve body surrounding said aperture and interconnected to said upper wall, a lower wall penetrated by an aperture of the same configuration and dimensions as the cross-section of said body of the apparatus and coaxially aligned with the longitudinal axis of said body of the apparatus, two parallel side walls each including a slide rail interconnected thereto and extending the full length of said side walls;

a generally planar valve plate disposed within said valve body resting upon said slide rails and having a plurality of cam shaft brackets on the lower surface thereof, each penetrated by an aperture with said apertures coaxially aligned with their mutual axis parallel to the longitudinal axis of said valve body;

a generally planar sealing basket disposed upon and interconnected to the upper surface of said valve plate to form a fluid-tight seal between said valve plate and said shallow ring interconnected to said upper wall of said valve body;

an elongate cam shaft inserted through the apertures of said cam shaft brackets in rotatable relation thereto, having a plurality of cam locks interconnected to said cam shaft and extending outwardly therefrom in the same plane and perpendicular to the longitudinal axis of said cam shaft;

a plurality of cam lock stops interconnected to the inner surface of the bottom wall of said valve body, disposed to arrest rotational movement of said cam shaft and cam locks in an optimum position to force said valve plate and said sealing gasket into a fluid-tight sealing relation against said shallow ring interconnected to the top wall of said valve body;

a handle shaft loosely interconnected to one end of said cam shaft and extending through an end wall of said valve body in fluid-tight slideable and rotational sealing relationship thereto.

15. The apparatus of claim 12, further including locking means for forming a positive lock between said hydrant adapter and the hydrant base, comprising:

a first bisected annular locking ring forming two half rings each with two ends, adapted to be placed around the hydrant base and interconnected at their mating ends in concentric relation to said hydrant base, having a plurality of set screws radially disposed about said first locking ring to be tightened against said hydrant base, and having a plurality of locking lugs radially disposed about said first locking ring and extending upwardly from its outer edge perpendicular to the plane of said first locking ring; and a second bisected annular locking ring forming two half rings with with two ends, adapted to be placed around the hydrant adapter and interconnected at their mating ends in concentric relation to said hydrant adapter, having a plurality of set screws radially disposed about said second locking ring to be tightened against said hydrant adapter, and having a plurality of slots radially disposed about the outer edge of said second locking ring to receive said locking lugs therein.

16. The apparatus of claim 12, wherein said wrench shaft of said hydrant valve wrench assembly is of substantially square cross-sectional configuration.

17. The apparatus of claim 12, wherein said valve wrench assembly further includes lifting means comprising:

a wrench shaft clamp to be inserted aroung the exterior of said wrench shaft;

tightening means for tightening said wrench shaft clamp firmly upon said wrench shaft;

a lifting bracket interconnected to said wrench shaft clamp and extending outward thereform; and a plurality of apertures in said lifting bracket for attachment of said lifting means to a hoist chain or cable.

18. The apparatus of claim 12, wherein the means of interconnecton between said valve engagement socket and said wrench shaft of said hydrant valve wrench comprises:

a mounting flange with a central aperture, inserted over the lower end of said wrench shaft and rigidly interconnected thereto near such lower end;

a mounting plate with a central aperture of larger dimension than the cross-sectional dimension of said wrench shaft, interconnected to the end of said valve engagement socket opposite the open end of said valve engagement socket in coaxial alignment with the longitudinal axis of said wrench shaft, which extends through said central aperture a short distance into the interior of said valve engagement socket;

a plurality of coil springs each having a hollow interior and open ends, disposed between said mounting flange and said mounting plate;

a plurality of bolts, numbering approximately one half the number of said coil springs, each such bolt being inserted through an aperture near the outer edge of said mounting plate, through the interior of one of said coil springs, and threaded into an aperture near the outer edge of said mounting flange, with said bolts evenly spaced around said mounting plate and said mounting flange; and a plurality of studs, of a number equal to the total number of said coil springs less the total number of said bolts, each said stud being attached at one end to said mounting flange near the outer edge thereof and perpendicular thereto, extending through the interior of one of said coil springs not having one of said bolts extending therethrough, and extending through an aperture near the outer edge thereof, with said studs evenly spaced around said mounting plate and said mounting flange alternate with said bolts.

19. The apparatus of claim 12, wherein said lifting rod clamp includes a continuous slot extending from the outer surface of said lifting rod clamp toward the interior thereof in a plane perpendicular to the longitudinal axis of said lifting rod clamp, and further wherein said hydrant valve control means comprises:

a hollow open ended cylindrical coupler interconnected to the end of said wrench shaft opposite its interconnection to said valve engagement socket, having female screw threads on the interior surface thereof;

a hollow open ended shaft plug having male screw threads on the exterior thereof and female screw threads on the interior thereof, interconnected to said coupler by threading said plug partially into the interior of said coupler in coaxial alignment therewith;

a hollow open ended cylindrical nipple having male screw threads on the exterior thereof, interconnected to said shaft plug by threading one end of said cylindrical nipple partially into the interior of said shaft plug in coaxial alignment therewith;

a control nut having female screw threads on the interior thereof, adjustably interconnected to said cylindrical nipple by threading said control not onto the exterior of said cylindrical nipple;

a pair of control plates each pivotally interconnected at one end to the outer edge of said control nut in opposing relation;

a pair of elongate control handles each interconnected at one end to one of said control plates and extending outwardly therefrom;

a semi-cylindrical control plate alignment bracket having two edges, with each such edge interconnected to one edge of one of said control plates to maintain the alignment of each of said control plates relative to the other;

a lifting rod clamp engagement plate extending between said control plates and pivotally interconnected to the ends of said control plates opposite their interconnection to said control nut, said engagement plate having a cutout extending into said plate from one edge thereof to receive said lifting rod clamp therein with the edges of said engagement plate surrounding said cutout extending into said slot in said lifting rod clamp; and a swivel latch interconnected at one end to the edge of said engagement plate from which said cutout extends and having a tab interconnected to the opposite end of said swivel latch to rest upon the upper surface of said engagement plate when said swivel latch is rotated about its pivotal interconnection to lie along the edge of said engagement plate to retain said lifting rod clamp within said cutout in said engagement plate.

20. The apparatus of claim 12, wherein the thrust bearing of the blow-out preventer and hydrant valve hold-down assembly comprises:

a flat thrust bearing plate having a central aperture of the same configuration as the cross-sectional configuration of said wrench shaft and of slightly larger dimension that said wrench shaft, to receive said wrench shaft therethrough;

a hollow open ended thrust bearing clamp of the same cross-sectional configuration as said wrench shaft and of slightly larger cross-sectional dimensions than said wrench shaft, interconnected to said thrust bearing plate with the longitudinal axis of said thrust bearing clamp aligned with the axis of said central aperture of said thrust bearing plate;

a set screw threaded through an aperture in a side wall of said thrust bearing clamp into the interior thereof toward the longitudinal axis of said thrust bearing clamp to be tightened against said wrench shaft to be inserted through said thrust bearing clamp;

a plurality of roller bearings disposed in apertures radially disposed about the upper surface of said thrust bearing plate, with the longitudinal axes of said roller bearings intersecting at the axis of said central aperture of said thrust bearing plate; and a flat floating plate having a central aperture of sufficient size to receive said thrust bearing clamp therethrough, disposed concentric with said thrust bearing plate and resting upon said roller bearings, said floating plate extending outwardly beyond the outer edge of said thrust bearing plate and having a plurality of apertures symetrically disposed around said floating plate outward of the outer edge of said thrust bearing plate to receive said elongate flexible retainers of said blow-out preventer and hydrant valve hold-down assembly.

21. The apparatus of claim 12, wherein said elongate flexible retainers of said blow-out preventer and hydrant valve hold-down assembly comprise cables.

22. The apparatus of claim 12, wherein said elongate flexible retainers of said blow-out preventer and hydrant valve hold-down assembly comprise chains.

23. The apparatus of claim 12, wherein said actuating means of said hydrant valve wrench actuator comprises a double acting hydraulic cylinder and piston assembly.

24. The apparatus of claim 12, wherein said wrench activation plate is circular in plan view and includes a pair of short hollow open ended cylindrical shoulders, each interconnected to a different face of said wrench activation plate coaxially aligned with each other and with the axis of the central aperture of said wrench activation plate, said wrench activation plate further includes a plurality of gear teeth evenly spaced about its outer edge, and said moveable lever arm of said hydrant valve wrench actuator comprises:

a pair of elongate flat plates of generally triangular configuration with convexly rounded base and apex, interconnected in superimposed parallel relation with said flat plates separated a short distance by a plurality of spacers disposed between said flat plates, having said wrench activation plate disposed between said flat plates near their rounded base ends;

a pair of apertures, one penetrating each of said flat plates near its rounded base end, said apertures being coaxially aligned with each other and with the axis of said central aperture of said wrench activation plate disposed between said flat plates, with one of said cylindrical shoulders of said wrench activation plate extending through each of said apertures in said flat plates, allowing said wrench activation plate to rotate about the axis of its central aperture relative to said flat plates;

a rachet cam disposed between said flat plates in engagement with said gear teeth of said wrench activation plate and retained in position by a cam pin extending through an aperture in said rachet cam and interconnected at each end to one of said flat plates, with said rachet cam rotatable about said cam pin; and bias means to selectively maintain said rachet cam in engagement with said gear teeth of said wrench activation plate.

25. An apparatus to be used in connection with a high pressure hydrant incorporating a hydrant base, a hydrant valve and valve seat interconnected to the hydrant base by mating screw threads, and one or more fluid lines interconnected to the hydrant base to conduct fluid to or from the hydrant base, each of such one or more fluid lines having a shut-off valve, for the purpose of removing and replacing the hydrant valve and valve seat relative to the hydrant base without imposing a net rotational force between the hydrant base and fluid lines interconnected thereto, comprising:

an elongate hollow body having a first open end adapted to be releaseably interconnected to the hydrant base so as to prevent rotation of said body about its longitudinal axis relative to said hydrant base, and a second open end coaxially aligned with said first open end;

a hydrant valve wrench assembly to be inserted through the hollow interior of said body in coaxial alignment with said body, having a valve engagement a socket open at one end to be inserted over the hydrant valve and valve seat in engagement therewith for the purpose of transfering rotational force thereto, and an elongate wrench shaft interconnected at one end to the end of said valve engagement socket opposite its open end, with said valve engagement socket and said wrench shaft in coaxial alignment;

a wrench shaft alignment bearing disposed around said wrench shaft and interconnected to said body at its second end to retain said wrench shaft in coaxial alignment with the longitudinal axis of said body while allowing rotation of said wrench shaft relative to said body;

a wrench activation plate having a central aperture of the same configuration as the cross-sectional configuration of said wrench shaft to receive said wrench shaft therethrough, adapted to allow longitudinal movement of said wrench activation plate relative to said wrench shaft but prevent rotation of said wrench activation plate relative to said wrench shaft; and hydrant valve wrench assembly actuating means having a fixed lever arm with first and second ends, interconnected at its first end to said body and extending outwardly therefrom, a moveable lever arm with first and second ends, releaseably interconnected at its first end to said wrench activation plate and extending outwardly beyond the outer edge of said wrench activation plate, and a wrench actuator interconnected between the second ends of said fixed lever arm and said moveable lever arm in order to apply force between said second ends of said respective lever arms upon activation of said wrench actuator, causing rotation of said moveable lever arm, said wrench activation plate, said wrench shaft, said valve engagement socket, and said hydrant valve and valve seat about the longitudinal axis of said body, such rotation being relative to said body and interconnected hydrant base without transfer of net rotational force through said body to said hydrant base.

26. In an apparatus for repairing a high pressure hydrant incorporating a hydrant base, a hydrant valve and valve seat interconnected to the hydrant base by mating screw threads, and one or more fluid lines interconnected to the hydrant base to conduct pressurized fluid to or from the hydrant base below the hydrant valve and valve seat, with such apparatus having an elongate hollow open ended body to be interconnected at one end to the hydrant base, and a hydrant valve and valve seat wrench assembly to engage the hydrant valve and valve seat for transfer of rotational force thereto, with an elongate wrench shaft extending through the interior of said body and upward above said body, a hydrant valve and valve seat wrench actuating assembly comprising:

a flat wrench activation plate of circular configuration having a central aperture of the same configuration as the cross-sectional configuration of the wrench shaft of the hydrant valve and valve seat wrench assembly and of slightly larger dimension than the crosssectional dimension of said wrench shaft to receive said wrench shaft therethrough, said wrench activation plate being adapted to allow longitudinal movement of said wrench shaft through said central aperture relative to said wrench activation plate but prevent rotational movement of said wrench shaft relative to said wrench activation plate;

a hollow open ended cylindrical bearing shoulder of larger cross-sectional dimension than said central aperture of said wrench activation plate, disposed on one face of said wrench activation plate and interconnected thereto in coaxial alignment with said central aperture of said wrench activation plate;

an annular ring gear having gear teeth disposed around its outer edge, disposed on the same face of said wrench activation plate to which said bearing shoulder is interconnected, around said shoulder, and interconnected to said wrench activation plate;

an elongate lever arm with first and second ends, having a bearing collar interconnected to said lever arm at its first end, said bearing collar being adapted to be placed around said bearing shoulder interconnected to said wrench activation plate in sliding relation therewith, an aperture intermediate its first and second ends to receive the shaft of a high torque rotary motor therethrough, and a wrench activation plate support bracket interconnected to one side of said lever arm intermediate its first and second ends to support the outer edge of said wrench activation plate when said bearing collar of said lever arm is placed around said bearing shoulder of said wrench activation plate;

a high torque rotary motor disposed on the side of said lever arm opposite said wrench activation plate support bracket and interconnected thereto, having an output shaft extending through said aperture in said lever arm, and a gear wheel coaxially aligned with said output shaft and interconnected to the end thereof extending through said aperture, such that said gear wheel is engaged with the gear teeth of said ring gear interconnected to said wrench activation plate when said bearing collar of said lever arm is placed around said bearing shoulder of said wrench activation plate; and lever arm restraint means interconnected between the second end of said lever arm and the body of the apparatus to restrain rotation of said lever arm relative to said body of the apparatus upon activation of said high torque motor to induce rotation of said wrench activation plate and, through said wrench activation plate, rotation of the hydrant valve and valve seat wrench assembly and hydrant valve and valve seat for removal or replacement thereof in the hydrant base.

* * * * *